United States Patent [19]

Eckelt

[11] Patent Number: 4,837,996

[45] Date of Patent: Jun. 13, 1989

[54] GLASS FACADE

[76] Inventor: Josef Eckelt, Saass 56, A-4421 Aschach, Austria

[21] Appl. No.: 166,685

[22] Filed: Mar. 11, 1988

[30] Foreign Application Priority Data

Mar. 20, 1987 [AT] Austria ..... 668/87

[51] Int. Cl.[4] ..... E04B 2/88

[52] U.S. Cl. ..... 52/235

[58] Field of Search ..... 52/235, 475, 396, 397

[56] References Cited

U.S. PATENT DOCUMENTS

| | | | |
|---|---|---|---|
| 2,698,975 | 1/1955 | Sharp | 52/475 |
| 3,672,107 | 6/1972 | Santry | 52/235 |
| 4,121,396 | 10/1978 | Oogami | 52/235 |
| 4,662,135 | 5/1987 | Tanikawa | 52/235 |

FOREIGN PATENT DOCUMENTS

| | | | |
|---|---|---|---|
| 379186 | 11/1985 | Austria . | |
| 2376266 | 9/1978 | France | 52/235 |

*Primary Examiner*—John E. Murtagh
*Attorney, Agent, or Firm*—Kurt Kelman

[57] ABSTRACT

A glass facade (1) consists of glass plates (2), the top and bottom edge portions of which extend in grooves (4) formed in carrying bars (5*a*) and containing a permanently elastic sealing compound (7). At least one of the side faces (4*a*) of each groove (4) is outwardly inclined. Said edge portions have chamfered faces (3*a*), which face and are substantially parallel to respective ones of said inclined side face (4*a*).

In order to simplify the assembling of the glass facade and to permit the glass plates to be mounted in various ways, the carrying bars (5*a*) are connected by side bars (5*b*) to form frames (5), which can be premounted on respective glass plates (2). Each of said carrying and side bars comprises webs (9), which extend on the inside of the glass plate. Each of said frames comprises mounting flange means (9*a*), which are integral with said webs (9) and extend away from the glass plate (2) and are mounted on a carrying structure (8) of the facade.

3 Claims, 2 Drawing Sheets

GLASS FACADE

BACKGROUND OF THE INVENTION

1. Field of the Invention

This invention relates to a glass facade comprising glass plates which have top and bottom edges in contact with a permanently elastic sealing compound in grooves formed in carrying bars. At least one of the side faces of each groove in the carrying bars is outwardly inclined and the glass plates have beveled edge faces which face and are substantially parallel to these inclined side faces.

2. Description of the Prior Art

Such glass facades known from Austrian patent specification No. 379,186 have proved highly satisfactory because they permit the glass plates to be mounted in a common plane on a carrying structure and to be adhesively joined to the carrying bars by the permanently elastic sealing compound and to be mechanically held in the grooves of the carrying bars without a risk of damage to the glass plates. However the carrying bars must be secured to the carrying structure before the glass plates can be inserted into the grooves of the carrying bars on the site so that the glazing work is still rather complicated and cannot be performed unless the weather is good. Besides, the glass plates used in such facades are permanently fixed in position and hinged glass plates cannot be installed.

SUMMARY OF THE INVENTION

It is an object of these invention to eliminate the disadvantages set forth hereinbefore and so to improve a glass facade which is of the kind described first hereinbefore that the manufacture and assembling are simplified further and hinged glass plates can also be installed.

That object is accomplished in accordance with the invention by combining the carrying bars and side bars connecting the carrying bars in frames which are associated with respective glass plates. Each bar comprises a web, extending on the inside of the glass plate, and each frame comprises mounting flange means, integral with the webs extending away from the glass plate and mounted on the carrying structure of the facade. As a result, each glass plate can be fitted into the carrying and side bars of the frame in the factory so that the facade can be assembled in an economical manner. On the site, the entire facade can be constructed by mounting the mounting flanges of the frames provided with the glass plates on the carrying structure in an operation which can be performed quickly and virtually in any weather.

The mounting flanges of the frames can be mounted on the carrying structure virtually in any desired manner. Within the scope of the invention it will be particularly desirable to provide the mounting flanges at the side bars with mounting pins, which can be hooked into hook-shaped slots of the carrying structure. In that case the frames can simply be hung into the carrying structure by a few manual operations. The frames which have been hung into the carrying structure may be locked, e.g., by locking screws, in order to render a removal of the frames more difficult.

A channel-shaped aligning bar may be provided on the carrying structure between adjacent side bars of adjacent frames. In that case the frames and glass plates can easily be aligned with each other so that the assembling of the facade will be facilitated particularly if the frames are hung into the carrying structure.

In a particularly preferred embodiment of the invention, the mounting flanges are provided with hinge means by which the frames can be hinged to the carrying wall. Such hinged frames will permit the facade to be provided with windows which can be opened.

The sealing of the gaps remaining between adjacent frames can be facilitated by the provision of cover strips, which are attached to the mounting flanges of the frame bars, preferably at the carrying bars. Owing to the provision of these cover strips, the gaps are closed on the inside and can quickly and neatly be filled with a permanently elastic sealing compound.

DETAILED DESCRIPTION OF THE PREFERRED EMBODIMENT

Figure 1:
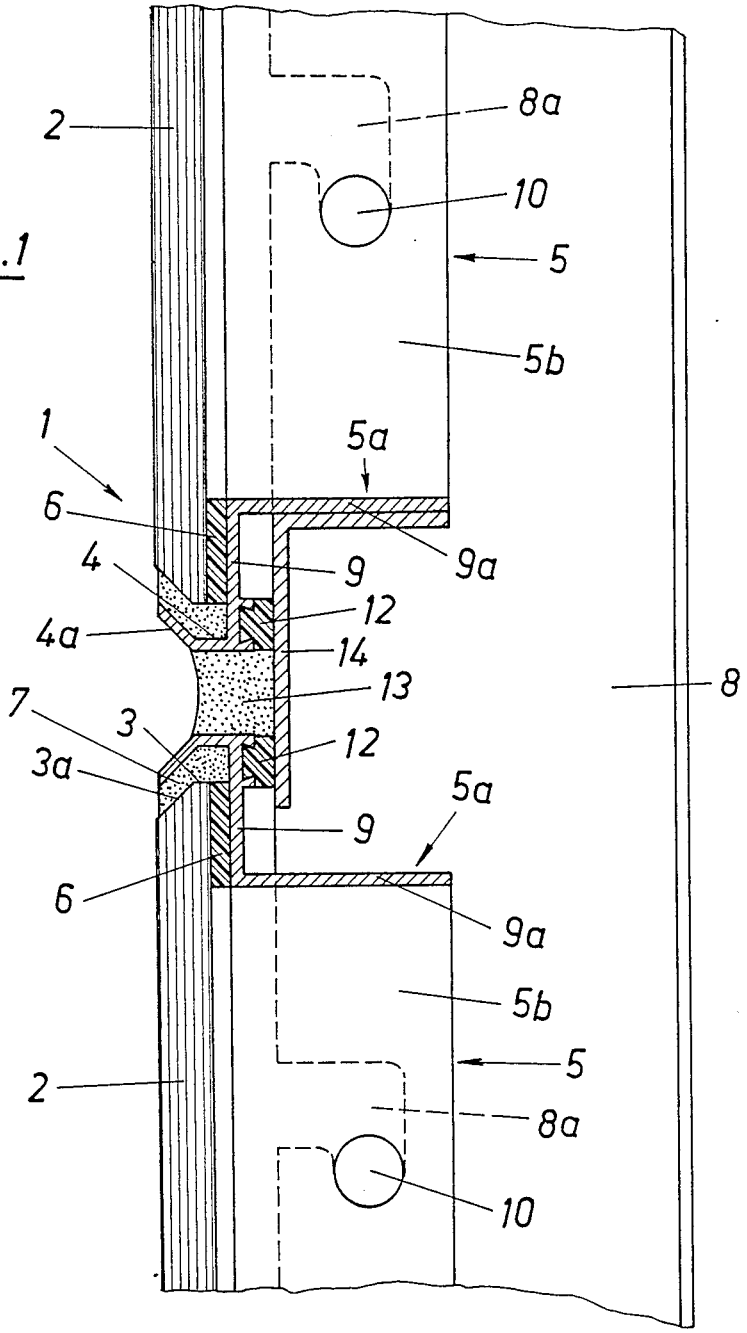
FIGS. 1 and 2 are, respectively, a vertical sectional view and a horizontal sectional view showing a glass facade which embodies the invention.
Figure 2:
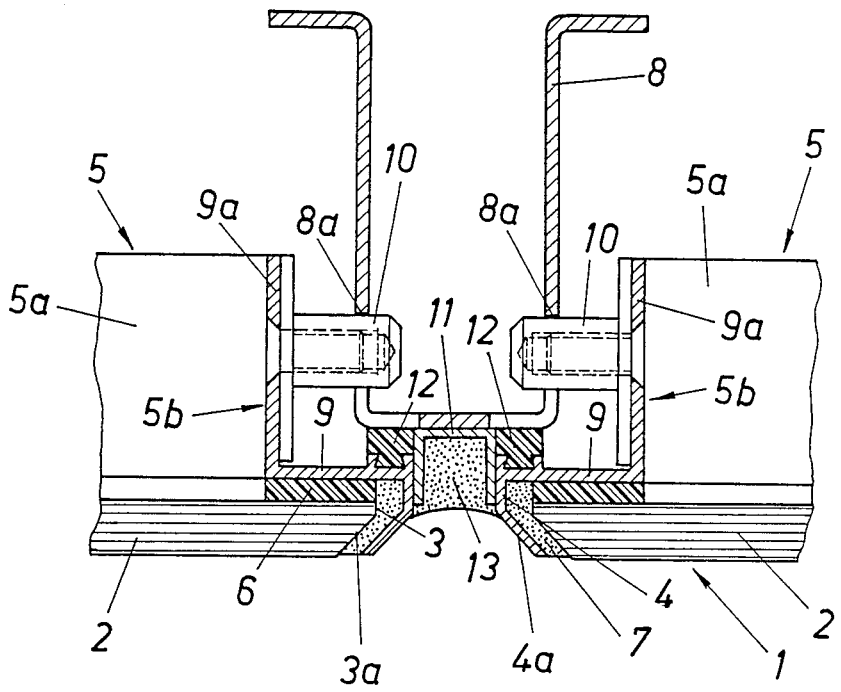

An illustrative embodiment of the invention is diagrammatically illustrated in the drawing.

A glass facade 1 comprises a plurality of glass plates 2 having edge portions 3 extending in grooves 4 formed in frames 5, which are associated with respective glass plates. Each frame 5 is composed of two verticaly spaced apart top and bottom carrying bars 5*a* and of two horizontally spaced apart side bars 5*b*, which connect the carryng bars 5*a*. To ensure that each glass plate 2 will be centered in and flush with the associated frame 5, those side faces 4a of the grooves 4 which face away from the carrying wall are outwardly inclined and the edge portions 3 of the glass plates 2 have beveled faces 3*a*, which face and are substantially parallel to the inclined side faces 4*a*. In order to fix the glass plates 2 in position and to seal them in the grooves 4, the grooves 4 contain elastic cushioning strips 6 and a layer 7 consisting of a permanently elastic sealing compound.

The glass plates 2 may be assembled with the frames 5 in the factory to provide prefabricated panels which can be mounted on the site on a carrying structure in a quick and economical operation. For that purpose each of the carrying and side bars 5*a*, 5*b* comprises a web 9, which extends on the inside of the glass plate 2, and a mounting flange 9*a*, which is integral with the web 9 and extends away from the glass plate 2. The mounting flanges 9*a* of the side bars 5*b* are provided with mounting pins 10. the frames 5 provided with the glass plates 2 can be mounted on the carrying structure, which is represented by upright posts 8, by hooking pins 10 into hook-shaped slots 8*a* formed in the carrying structure. The aligning of laterally adjacent frames 5 can be facilitated by the provision of vertical aligning bars 11, which are provided on the carrying structure 8 between the adjacent connecting bars 5*b* of adjacent frames 5 and will prevent a lateral slipping of the frames 5 after the latter have been fitted. The facade 1 will be sealed by the provision of profiled sealing strips 12 between the frames 5 and the carrying structure 8 and by a permanently elastic sealing compound 13 which fills the gaps remaining between adjacent frames 5. The sealing of the facade will be improved and facilitated if cover strips 14 are attached to the mounting flanges 9*a* of the carrying bars 5*a*.

Owing to the provision of frames 5 associated with respective glass plates 2, the panels can be prefabricated and the frame glass plates can quickly be assembled on the site. Besides, the glass plates 2 provided with the frames 5 can be secured to the carrying structure 8 in any desired manner. For instance, individual glass panels 5 can be hinged to the carrying structure by means which are not shown in detail so that the glass facade 1 may include windows which can be opened outwardly. Moreover, the frames 5 may contain different glass plates so that a given facade may contain different glass plates panels comprising single glass plates or insulating glass panels, laminated glass panels or other multiple glass panels.

In the manufacture of a glass panel consisting of a frame 5 and a glass plate 2, the latter is inserted into the prefabricated frame and is fixed therein by introducing the sealing compound 7 into the grooves 4.

I claim:

1. A glass facade comprising (a) a plurality of prefabricated glass panels, each panel including (1) a glass plate having an outside face, an inside face, two vertically spaced edges and two horizontally spaced edges,. the edges extending between the outside and inside faces of the glass plate, (2) a frame comprised essentially of two vertically spaced carrying bars and two horizontally spaced side bars connecting the carrying bars, each of the bars including a side face having a portion inclined outwardly towards the outside face of the glass plate and extending no farther than the outside face, a web subtending the inside face of the glass plate, the side face and web of the bar defining a groove receiving a respective one of the edges of the glass plate, and each of the edges having a beveled portion extending substantially parallel to the outwardly inclined portion of the side face, and a mounting flange integral with the web and extending inwardly away from the inside face of the glass plate, at least two of said glass panels being laterally adjacent each other whereby the frames of the laterally adjacent panels have laterally adjacent side bars, and (3) a permanently elastic sealing compound filling the grooves between the edges and the side faces, and (b) a carrying structure behind the inside face of the glass plate whereon the flanges of the frame bars are mounted, the carrying structure including a channel-shaped aligning bar extending vertically between the laterally adjacent side bars.

2. The glass facade of claim 1, wherein the carrying structure defines hook-shaped slots, and further comprising mounting pins on the mounting flanges of side bars, the mounting pins being engaged in the hook-shaped slots.

3. The glass facade of claim 1, wherein at least two of said glass panels are vertically adjacent each other whereby the frames of the vertically adjacent panels have vertically adjacent carrying bars defining a gap therebetween, and the carrying bars have cover strips extending over and sealing the gaps between the carrying bars.

* * * * *